US006080922A

United States Patent [19]

Dimbath

[11] Patent Number: 6,080,922

[45] Date of Patent: Jun. 27, 2000

[54] DISENGAGEABLE BELT ATTACHMENT AND IN PARTICULAR SHOULDER STRAP FOR PORTABLE MUSICAL INSTRUMENTS AND FOR PREFERABLY GUITARS

[76] Inventor: Wolfgang Dimbath, Werner-von-Siemensstrasse 14, 91052 Erlangen, Germany

[21] Appl. No.: 09/143,345

[22] Filed: Aug. 28, 1998

[30] Foreign Application Priority Data

Aug. 28, 1997 [DE] Germany ..... 197 37 572

[51] Int. Cl.[7] ..... G10D 3/00

[52] U.S. Cl. ..... 84/327; 84/453; 84/421

[58] Field of Search ..... 84/453, 327, 421; D11/200, 212

[56] References Cited

U.S. PATENT DOCUMENTS

| | | | |
|---|---|---|---|
| 1,647,783 | 11/1927 | Carr . | |
| 3,512,226 | 5/1970 | Carlile . | |
| 4,144,794 | 3/1979 | Silverman . | |
| 4,400,857 | 8/1983 | Morinaga | 24/230 |
| 4,404,715 | 9/1983 | Sugimoto | 24/230 |
| 4,490,892 | 1/1985 | Ueda | 24/641 |
| 4,715,259 | 12/1987 | Wittman | 84/327 |
| 4,901,900 | 2/1990 | Goto . | |
| 4,993,127 | 2/1991 | Mechem et al. | 24/701 |
| 5,615,462 | 4/1997 | Goto . | |

FOREIGN PATENT DOCUMENTS

| | | |
|---|---|---|
| 0485733 | 10/1991 | European Pat. Off. . |
| 8022253 | 3/1980 | Germany . |
| 2933845 | 5/1989 | Germany . |
| 4235491 | 4/1994 | Germany . |
| 2-211648 | 7/1989 | United Kingdom . |

*Primary Examiner*—Robert E. Nappi
*Assistant Examiner*—Kim Lockett
*Attorney, Agent, or Firm*—Collard & Roe, PC

[57] ABSTRACT

A disengageable belt attachment for detachably engaging a belt to an anchoring element of a portable musical instrument has an end piece anchoring the belt at an end of the belt. The anchoring element has a round head and an elongated shaft. The end piece includes a lockable coupling housing comprising a plate having a head-receiving opening, a shaft-receiving opening, a locking cover swivelably supported on the plate by a hinge on an end of the plate facing the belt, and an internal snap-in device. The locking cover is provided at its underside with a projecting locking profile formed by profile flanks projecting substantially semicircularly from the underside of the locking cover. The head-receiving opening is sized to fit over the head of the anchoring element. The shaft-receiving opening is adapted to longitudinally displace the coupling housing when the head-receiving opening is placed over the head of the anchoring element by engaging the shaft of the anchoring element. The locking cover has a closed position wherein the projecting locking profile prevents an unlocking longitudinal displacement of the coupling housing and assures a rotary coupling motion of the coupling housing around the axis of the anchoring element. The profile flanks engage the inner circumferential faces of the head of the anchoring element facing away from the shaft-receiving opening. The snap-in device locks the locking cover against an unintended opening.

12 Claims, 3 Drawing Sheets

(DETAIL X)

Figure 1:
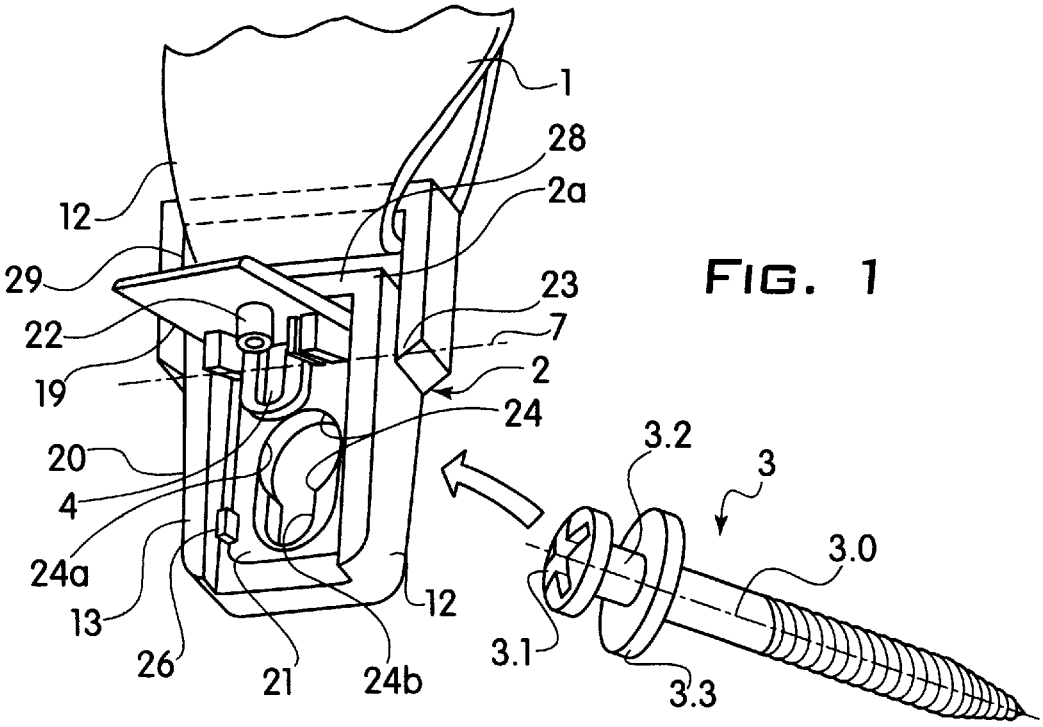

DISENGAGEABLE BELT ATTACHMENT AND IN PARTICULAR SHOULDER STRAP FOR PORTABLE MUSICAL INSTRUMENTS AND FOR PREFERABLY GUITARS

The invention relates to a disengageable belt attachment, in particular a shoulder strap attachment for portable musical instruments, preferably for guitars, with a cap set screw or the like disposed at least at one anchoring point of the instrument body, wherein the belt can be anchored at least at one of its ends with an end piece—lockingly against an unintended detachment—to the cap set screw and can be disengaged again from the cap set screw, wherein the end piece is a lockable coupling housing comprised of a floor-side orifice plate or swage plate with a keyhole-like opening and an openable and closable locking cover, which locking cover is swivelably supported at the orifice plate or swage plate. The locking cover is provided at its underside with a projecting locking profile. In addition, the keyhole-like opening fits with a round through opening over the head of the cap set screw. An elongated and round curved shaft-receiver opening is disposed adjoining to the through opening and is adapted to the shaft of the cap set screw such that the still open coupling housing, placed with its through opening over the head of the cap set screw, can be brought with a longitudinal displacement into engagement with the opening edges of its shaft-receiver opening with the shaft of the cap set screw by gripping under the head of the cap set screw. After closing the locking cover with the projecting locking profile, an unlocking longitudinal displacement of the coupling housing is prevented, however, a rotary coupling motion around the cap set screw axis is assured.

Such a disengageable belt attachment is known from the U.S. Pat. No. 4,993,127 (L. J. Mechem et al.). The locking cover is distally hinged in this known construction, i.e. at the free end of the swage plate. When the shaft of the cap set screw reaches into the shaft-receiver opening or, respectively, the oblong hole based on a longitudinal displacement of the placed on and mounted coupling housing, the locking cover is closed, and when a cylinder projection at the inner side of the cover reaches into the through opening, however, the cylinder projection locks the through opening only incompletely. The locking position has therefore still to be secured. For this purpose, a band, anchored at the swage plate, penetrates the free end of the locking cover through a slot and has a snap fastener at the free end, projecting over the cover, wherein the snap faster can be buttoned onto a "nipple" of the cover in its closing position. Four operating steps are to be performed for coupling the belt to the instrument: 1) placing the coupling housing onto the cap set screw, 2) longitudinal displacement of the coupling housing, 3) closing the locking cover, and 4) assuring the locking position by buttoning the snap fastener.

It is an object of the invention to provide for a detachable belt attachment of the initially defined kind, wherein at the most three operating steps are required for coupling the instrument belt, namely placement of the locking cover, longitudinal displacement of the locking cover, and closure of the locking cover.

An additional object comprises constructing the belt attachment or, respectively, the construction of the coupling housing such that the possibility is open to support or to effect the longitudinal displacement of the swage plate with the closure motion of the locking cover such that two operating steps suffice in the latter-named case.

An additional object is to assure a convenient handling during the mounting and demounting of the belt attachment as well as a stable, tension-proof mounting support of the instrument to its mounted belt.

According to the invention, the object of the species of belt attachment is solved by the features recited in the characteristics of the claim 1, namely in that

- the locking cover is hinged at the belt-side end of the swage plate,
- the locking profile is formed by profile flanks, projecting at least essentially semi-circularly from the underside of the locking cover, wherein the profile flanks engage in the coupled, locked state of the coupling housing with the inner circumferential faces at that half of the head of the cap set screw which half faces away from the shaft-receiver opening, and
- the locking cover is lockable against an unintended opening in its closed position by a coupling-housing-internal snap-in device.

Advantageous further developments are indicated in the claims 2 to 11.

The advantages achievable with the invention are in particular to be seen in that at the most three operating phases or steps are required for the coupling of the instrument belt. In this connection it is particularly advantageous for a stable locking if the swage plate and/or the locking cover are made of an elastically deformable material, in particular of an elastically deformable plastic material, and are formed in their closing shape profile such that the locking cover reaches its closure position based on a snap-in effect or, respectively, a click-stop effect. It is particularly advantageous for a high-quantity series production, for example in the injection-molding process, if both the swage plate and the locking cover are made of an elastically deformable plastic material. Suitable plastics are for example polyethylene, polypropylene or polyurethane. It is achieved according to the further development according to claim 8 that the longitudinal displacement of the swage plate can be effected or at least supported during the closing of the locking cover.

Figure 2:
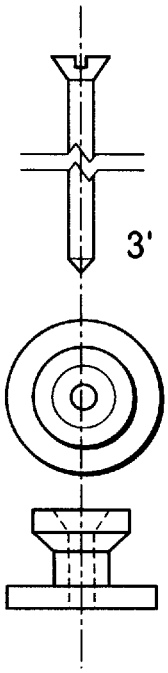
Figure 3:
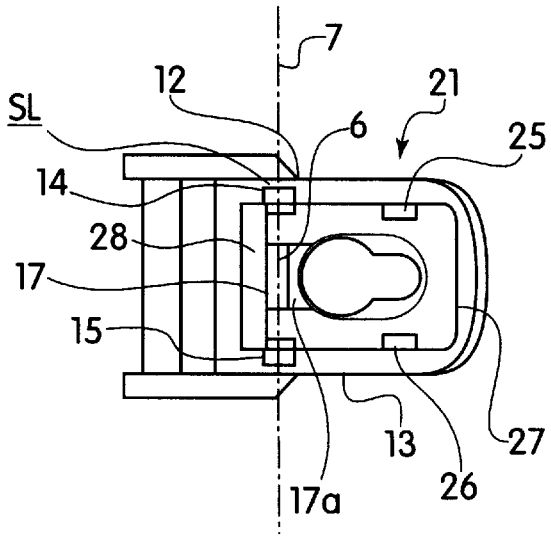
Figure 5:
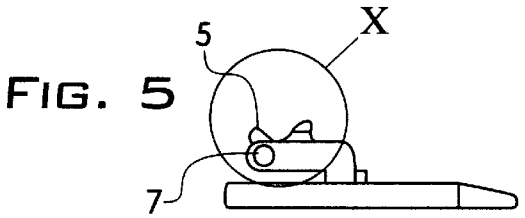
Figure 6:
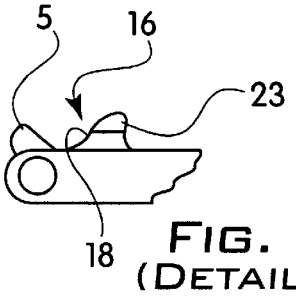
Figure 4:
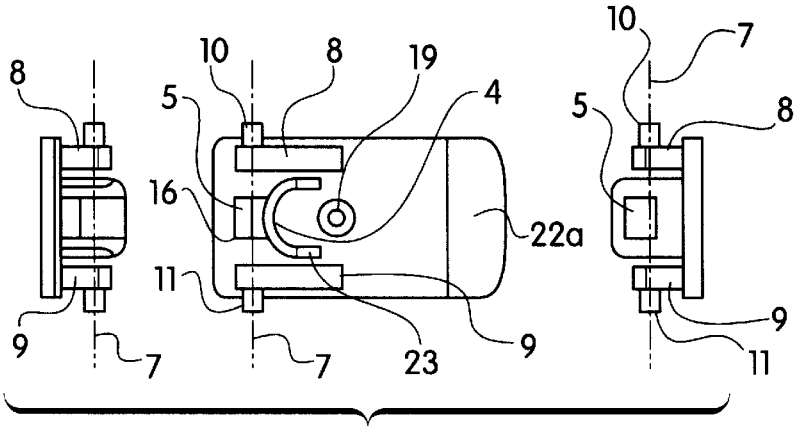
Figure 7:
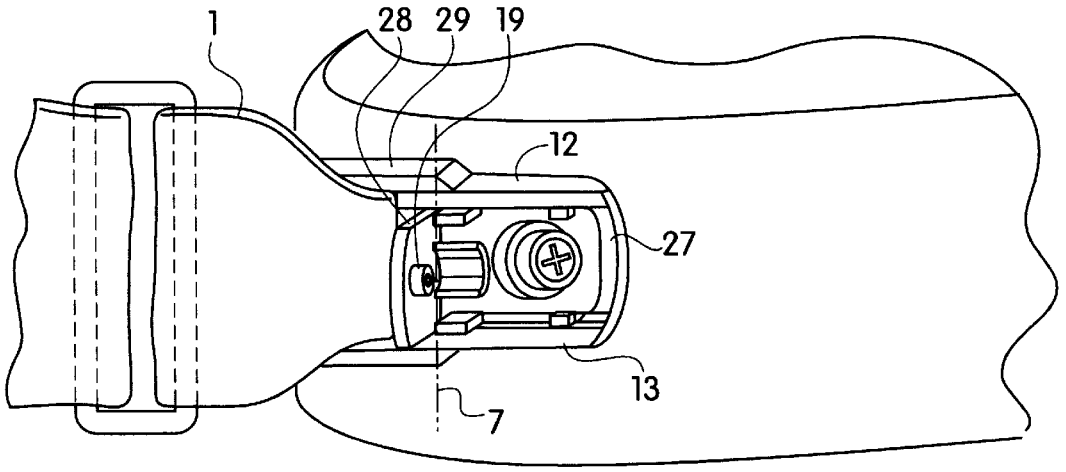
Figure 8:
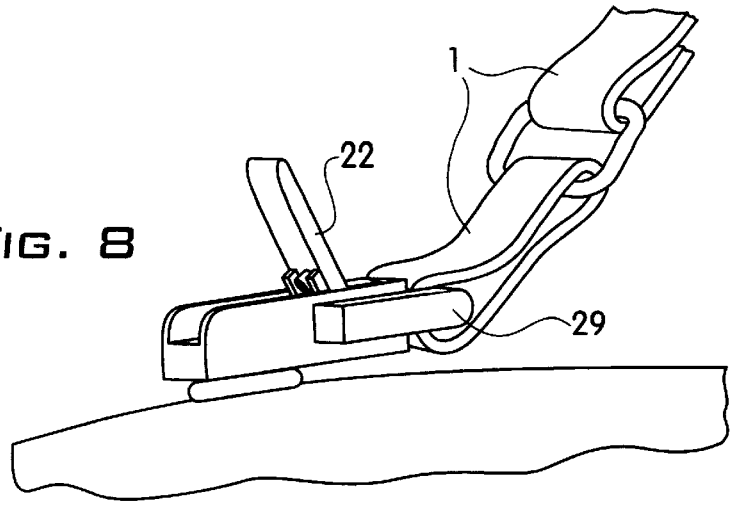
Figure 9:
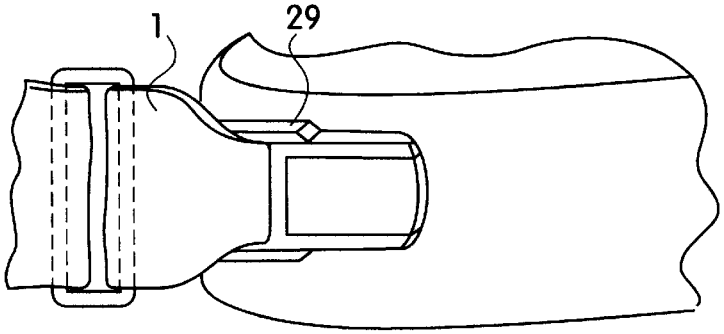
Figure 10:
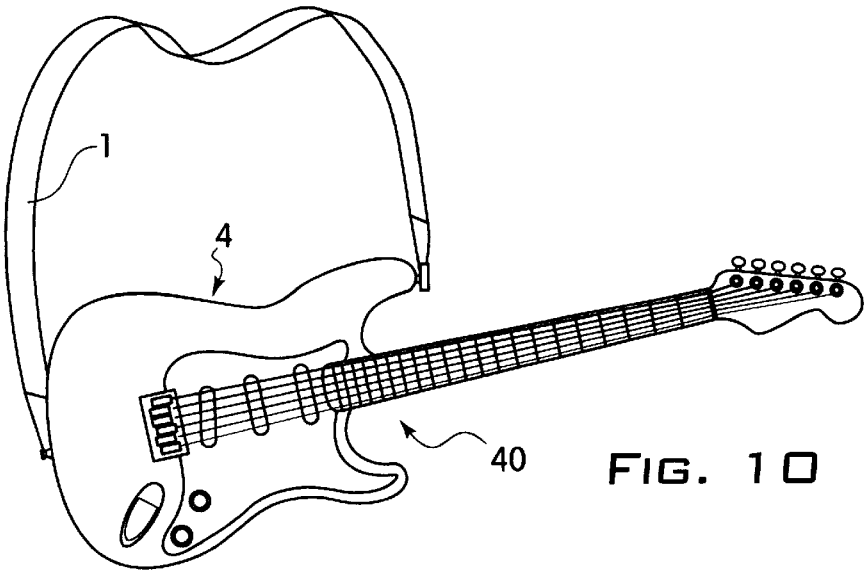

Additional characteristics and advantages as well as the construction and the method of operation of a belt attachment according to the invention are explained in detail in the following based on two exemplified embodiments shown in the drawings. There is shown in the drawing in a simplified, in part schematic representation:

FIG. 1 a coupling housing for an end piece at the end of a belt with an adjacently disposed cap set screw in a perspective representation obliquely from above, FIG. 2 a two-part cap set screw as an alternative to the one-part cap set screw according to FIG. 1, which screw is comprised of the screw proper and a head piece (shown in cross-sectional and elevational view), FIG. 3 the swage plate in a top view, FIG. 4 the locking cover in cross-sectional view and two side views, FIG. 5 the object according to FIG. 4, in a front elevational view, FIG. 6 the detail X of FIG. 5 enlarged and with a variation of the profile flanks in a structure of a slanted plane, FIG. 7 the object according to FIG. 1, set onto the cap set screw, wherein the swage plate is already slid over the shaft of the cap set screw and wherein only the locking cover has to be flipped and closed, FIG. 8 the object according to FIG. 7, viewed obliquely from the side, FIG. 9 the object according to FIG. 8 with a closed locking cover, in a top view obliquely from above, and FIG. 10 the belt attachment, shown in case of a shoulder belt for an electric guitar.

The detachable belt 1, shown in FIG. 1, has an end piece 2 at its end, wherein the detachable belt can be engagingly and lockingly or, respectively, disengageably and remountably attached with the end piece 2 to the portable musical instrument, and in fact to anchoring points. It is in particular a shoulder-strap attachment, preferably for guitars, with cap set screws or the like disposed at least at one anchoring point, and preferably disposed at two anchoring points of the instrument body 4 (compare FIG. 10). Such a cap set screw 3 is drawn in an exemplified way in FIG. 1 next to the end piece 2. The cap set screw 3 has a head 3.1, a shaft 3.2, and an annular collar 3.3, wherein the cap set screw 3 can be screwed into the instrument body 4 at the most up to the annular collar 3.3. A lockable coupling housing is attached at the belt end 1*a* as end piece 2. In the following, reference will only be made to coupling housing 2. This coupling housing 2 includes a floor-side swage plate 21 with a keyhole-like opening and an openable and closable locking cover 22, hingedly supported at the swage plate 21. The locking cover 22 is furnished at its underside with a projecting locking profile 23. A keyhole-like opening 24 with a round through opening 24*a* fits over the head 3.1 of the cap set screw 3, and an elongated and round curved shaft-receiver opening 24*b*, contiguous to and adjoining the through opening, is adapted to the shaft 3.2 of the cap set screw 3 such that the still open coupling housing 2, placed with its through opening 24 [Translator's remark: should read "24*a*"] over the head 3.1 of the cap set screw 3, is longitudinally displaced and can be brought with the opening edges of its shaft-receiver opening 24*b* into engagement with the shaft 3.2 of the cap set screw 3 by gripping under the head 3.1. After closing the locking cover 22 with the projecting locking profile 23, an unlocking longitudinal displacement of the coupling housing 2 is prevented, however, a rotary coupling motion around the cap set screw axis 3.0 is assured.

The locking cover 22 is hinged at the belt-side end 2A of the swage plate 21 according to the invention. In addition, the locking profile is formed of profile flanks 23, projecting at least semicircularly from the underside of the locking cover 22. The profile flanks 23 engage in the coupled, locked state of the coupling housing (FIG. 9) with inner circumferential faces 4 at that half of the cap set screw head 3.1 which faces away from the shaft-receiver opening 24*b*. An additional important feature is that the locking cover 22 can be locked in its locking position with a snap-in locking device 5, 6, disposed inside the coupling housing, for preventing an unintended opening. The snap-in locking device 5, 6 cannot be seen in FIG. 1 because it is disposed behind the profile flanks 23. The snap-in locking device 5, 6 is however illustrated in FIGS. 3 to 5 and is further dealt with below.

The swivel axis 7 of the locking cover is indicated with a dash-dotted line in FIG. 1 and in FIG. 7, and in addition in FIGS. 3 to 5, which swivel axis 7 is being described to in the following. For the hinged support, the locking cover 22 is provided with preferably formed-on side cheeks 8, 9 on its underside and in the region of its two longitudinal sides. The side cheeks 8, 9 are provided with laterally projecting pivot pins 10, 11, aligned along a single axis. The swage plate 21 exhibits at its two longitudinal sides reinforced side flanks 12, 13 with respective bearing recesses 14, 15, disposed opposite to each other and aligned along a single axis. The bearing recesses 14, 15 are associated with the respective pivot pins 10, 11. The side cheeks are formed as elastically deformable extensions or prolongations such that the locking cover 22 can be placed and inserted under elastic deformation of the extensions or prolongations with its pivot pins 10, 11 into the bearing recesses 14, 15.

The locking profile 23 has a concave inner contour (inner circumferential faces 4), facing the through opening 24*a*, and a convex outer contour 16, facing the pivot bearing SL. An (ideal) cylinder jacket is defined by the pivot pins 10, 11, wherein the cylinder jacket envelopes the gliding faces of the pivot pins 10, 11. The swage plate 21 exhibits a connection web 17 at its floor region, adjoining the through opening 24*a*. The preceding details are required in connection with the following explanation of the snap-in locking device 5, 6. The connection web 17 of the swage plate 21 exhibits the previously recited locking recess 6, for a snap-in connection. Adjacent to the locking profile 23 of the locking cover 22, a snap-in pin 18 with the snap-in tappet 5 is disposed or, respectively, formed at the free end of the snap-in tappet at the convex outer contour 16 of the locking profile 23. The snap-in profile of the snap-in tappet 5 is eccentrically disposed relative to the said ideal cylinder jacket such that the snap-in tappet 5 engages and locks with the snap-in locking recess 6 of the connection web 17 upon closing the locking cover 22. The snap-in locking recess 6 in the connection web 17 is formed by a step profile, which is disposed deeper or lower as compared to the outer side of the connection web 17, wherein there remains a higher disposed step profile 17*a* adjoining and abutting the through opening 24*a*. This higher step profile 17*a* is advantageously provided as a snap-in abutment for the snap-in tappets 5 for stabilizing the open position of the locking cover 22 (FIG. 1, FIG. 8).

According to FIG. 6, the locking profile 23 is provided with an enlarged sloped plane 18 at its convex outer contour 16, which is facing the head 3.1 of the cap set screw 3 in the open position of the locking cover 22, such that, upon closing motion of the locking cover 22, the sloped plane 18 comes into a force-matching engagement with the head 3.1 of the cap set screw 3 and exerts various forces of reaction onto the swage plate 21 which permits the shaft 3.2 of the cap set screw 3 to reach into the shaft-receiver opening 24*b* or, respectively, facilitate at least this displacement.

The locking cover 22 is provided with a first detent cam 19 at its underside in the region, which is disposed in the surface projection of the cap set screw head 3.1 in the closed position of the said cover 22, cf. also FIG. 1 and FIG. 7. A stop is thereby achieved for the head 3.1 of the cap set screw which makes possible a substantially play-free support of the coupling housing 20 substantially in the direction of the screw axis 3.0. Second detent cams 25, 26 are connected with this substantially play-free support, as explained in the following. The swage plate 21 has a front-side first reinforcement cross-web 27, facing away from the pivot bearing SL, and a rear-side second reinforcement cross-web 28 neighboring to the pivot bearing SL or, respectively, to the swivel axis 7. The second detent cams 25, 26 rest on the side flanks 12, 13 of the swage plate 21 and project inwardly. The locking cover 22 comes to rest with the second detent cams 25, 26 with surface regions of its underside in the closing position of the locking cover 22, which surface regions are disposed close to the free end of the locking cover 22. The free end 22*a* of the locking cover 22 is tapered tongue-like at its underside, wherein a gap remains free between the tapered end of the closed locking cover 22 and the first reinforcement cross-web 27, and wherein the locking cover extends over the first reinforcement cross web 27 by a small portion of for example 1 to 1.5 mm, for the purpose of providing a gripping surface for the thumb or fingertips for an easier opening of the locking cover 22. In other words, the said gap is always assured by the second detent cams 25, 26.

It can also be recognized from FIGS. 1, 3 and 7 to 9 that a belt attachment bow or bracket 29 is connected with the rear-side reinforcement cross web or, respectively, second reinforcement cross web 28 and with the adjoining parts of the side flanks 12, 13 of the swage plate 21, wherein the instrument belt 30 can be attached with a loop or the like to the belt attachment bow or bracket 29.

FIG. 10 shows an electrical guitar 40, wherein the belt strap 1 is attached at two anchoring points in form of (not shown) cap set screws to the two coupling housings 20 at the ends of the belt strap 1.

What is claimed is:

1. A disengageable belt attachment for detachably engaging a belt to an anchoring element of a portable musical instrument, the anchoring element having a round head and an elongated shaft, which comprises an end piece anchoring the belt at an end of the belt, said end piece comprising a lockable coupling housing comprising a plate having a head-receiving opening, a shaft-receiving opening, a locking cover swivelably supported on the plate by a hinge on an end of the plate facing the belt, and an internal snap-in device, said locking cover being provided at its underside with a projecting locking profile formed by profile flanks projecting substantially semi-circularly from the underside of the locking cover, said head-receiving opening being sized to fit over the head of the anchoring element, said shaft-receiving opening being adapted to longitudinally displace said coupling housing when said head-receiving opening is placed over the head of the anchoring element by engaging the shaft of the anchoring element, said locking cover having a closed position wherein said projecting locking profile prevents an unlocking longitudinal displacement of the coupling housing and assures a rotary coupling motion of the coupling housing around the axis of the anchoring element, wherein said profile flanks engage the inner circumferential faces of the head of the anchoring element facing away from the shaft-receiving opening, and wherein said snap-in device locks the locking cover against an unintended opening.

2. A belt attachment according to claim 1 wherein the plate is made of an elastically deformable plastic.

3. A belt attachment according to claim 1 wherein the locking cover is made of an elastically deformable plastic.

4. A belt attachment according to claim 1 wherein the locking cover has two longitudinal sides extending from its underside and the hinge for the locking cover is provided by side cheeks formed on the underside and on the two longitudinal sides, said cheeks having laterally projecting pivot pins aligned along a single axis, and wherein the plate comprises two longitudinal sides having reenforced side flanks with bearing recesses corresponding to the pivot pins, said bearing recesses having axes aligned with and disposed opposite each other.

5. A belt attachment according to claim 4 wherein said side cheeks are formed as elastically deformable extended prolongations such that the locking cover is insertably placed under elastic deformation of the extended prolongations with its pivot pins into the bearing recesses.

6. A belt attachment according to claim 5 wherein the locking profile has a concave inner contour facing the head-receiving opening and a convex outer contour facing the bearing recesses, wherein the pivot pins have gliding faces, said pivot pins defining an imaginary cylinder jacket enveloping the gliding faces of the pivot pins, and wherein the plate comprises a connection web at its floor region adjoining the head-receiving opening, said connection web comprising a snap-in locking recess, and wherein a snap-in pin is positioned at a free end of a snap-in tappet adjacent to the locking profile of the locking cover, said snap-in pin being formed at the convex outer contour of the locking profile, said snap-in tappet having a snap-in profile eccentrically disposed relative to the cylinder jacket such that the snap-in tappet becomes locked with the snap-in locking recess of the connection web upon closing the locking cover.

7. A belt attachment according to claim 6 wherein the snap-in locking recess in the connection web is formed by first step profile disposed below an outer side of the connection web and wherein the plate comprises a second step profile disposed above said first step profile and adjoining and abutting the head-receiving opening.

8. A belt attachment according to claim 6 wherein the second step profile comprises a snap-in abutment for the snap-in tappet for stabilizing the locking cover in an open position.

9. A belt attachment according to claim 4 wherein the locking profile has a convex outer contour facing the head of the anchor element when the locking cover is in an open position, said locking profile being provided with an enlarged sloped plane at the convex outer contour such that upon closing of the locking cover, the sloped plane comes into engagement with the head of the anchor element and exerts force onto the plate to permit the shaft of the anchor element to extend into the shaft-receiving opening.

10. A belt attachment according to claim 1 wherein the locking cover is provided with a first detent cam on its underside, said first detent cam being disposed against the head of the anchor element when said locking cover is in the closed position.

11. A belt attachment according to claim 4 wherein the plate includes a front-side first reinforcement cross-web facing away from the bearing recesses and a rear-side second reinforcement cross-web adjacent to the bearing recesses, and wherein the side flanks of the plate are provided with second inwardly projecting detent cams, said locking cover coming to rest on the surface of said second detent cams in the closed position, said side flanks being disposed near a free end of the locking cover, the free end being tapered to form a tongue on the underside of the locking cover, wherein a gap is formed between the tapered end of the locking cover and the first reinforcement cross-web in the closed position, and wherein the locking cover extends a small distance over the first reinforcement cross-web to provide a gripping surface for a user's finger to facilitate opening of the locking cover.

12. A belt attachment according to claim 11 further comprising a belt attachment bow connected with the rear-side reinforcement cross web or a second reinforcement cross web and with the adjoining parts of the side flanks of the plate, the belt being attachable to the belt attachment bow with a loop.

* * * * *